United States Patent [19]

Rothenpieler et al.

[11] Patent Number: 4,728,051

[45] Date of Patent: Mar. 1, 1988

[54] REVERSIBLE REEL ASSEMBLY

[75] Inventors: Manfred Rothenpieler, Siegen; Gerhard Diehl, Burbach, both of Fed. Rep. of Germany

[73] Assignee: SMS Schloemann-Siemag Aktiengesellschaft, Dusseldorf, Fed. Rep. of Germany

[21] Appl. No.: 923,312

[22] Filed: Oct. 27, 1986

[30] Foreign Application Priority Data

Oct. 31, 1985 [DE] Fed. Rep. of Germany ..... 3538677

[51] Int. Cl.[4] ..... B65H 75/34; B21C 47/02

[52] U.S. Cl. ..... 242/64; 242/78.1

[58] Field of Search ..... 242/56 A, 63, 64, 72, 242/56.9, 72.1, 79, 80, 82, 78.1

[56] References Cited

U.S. PATENT DOCUMENTS

| | | | |
|---|---|---|---|
| 1,956,906 | 8/1932 | Mikaelson . | |
| 3,666,194 | 5/1972 | Gosnell | 242/72 |
| 3,779,472 | 12/1973 | Boggs | 242/46.4 X |
| 3,870,244 | 3/1975 | Sarkisov et al. . | |
| 3,985,313 | 9/1976 | Klein et al. | 242/56 A X |
| 4,352,470 | 10/1982 | Blakeslee . | |

FOREIGN PATENT DOCUMENTS

| | | |
|---|---|---|
| 944424 | 6/1956 | Fed. Rep. of Germany . |
| 2727819 | 1/1979 | Fed. Rep. of Germany . |
| 3028607 | 2/1982 | Fed. Rep. of Germany . |
| 1164086 | 3/1968 | United Kingdom . |

*Primary Examiner*—John M. Jillions
*Assistant Examiner*—Steven M. duBois
*Attorney, Agent, or Firm*—Toren, McGeady & Associates

[57] ABSTRACT

A reversible reel assembly including two rotatable reels for successively, continuously winding rolled strip. The two reels are mounted on a rotatable head plate and are rotatably driven independently from each other. In order to supply the positioning drives of the reels with drive media, rotatable media supplies which are trouble-prone and expensive are required. In order to provide a reversible reel assembly without trouble-prone media supplies, a reel is suggested in which the reel drums are continuously spread-apart by means of the force of a spring and the positioning drives are arranged stationary independently from the reels, so that the reels can be moved into the positioning drives in certain positions and the movement of the segments between a position of rest and a spread-apart position can be effected in these positions.

11 Claims, 6 Drawing Figures

REVERSIBLE REEL ASSEMBLY

BACKGROUND OF THE INVENTION

1. Field of the Invention

The present invention relates to a reversible reel assembly including two rotatable reels for successively, continuously winding rolled strip. The two reels are mounted on a rotatable head plate and are rotatably driven independently from each other. Each reel is movable by a rotation of the head plate between an initial position and a strip coil transfer position. Each reel includes a drum formed by a plurality of segments which can be spread apart and have conically formed sliding surfaces with which they rest axially slidably against a tubular reel shaft mounted on the head plate. A plunger extends axially through each tubular shaft. The plunger is axially movable and its free end has a flange which is connected to the segments for moving the segments between a first position of rest and second spread-apart position.

2. Description of the Prior Art

Conventional reversible reel assemblies of the aforedescribed type have positioning drives which are fixedly connected to reels. These drives substantially increase the weights of the assembly which are to be accelerated and decelerated, so that large and expensive drives, gear units and couplings are required. The medium required for driving these positioning drives, for example, a hydraulic oil, is supplied through rotary supply units which are expensive and trouble-prone or through media couplings which connect the feed line to a pressure reservoir during the periods of standstill, for example, during the transfer of the strip coil. In an assembly of this type, a pressure reservoir is provided at each reel next to the positioning drive which is fixedly connected to the reel, wherein the pressure reservoir carries out the rotary movements together with the assembly, so that the resulting costs for the assembly and the operation are high.

It is, therefore, the primary object of the present invention to provide a reversible reel assembly of simple construction which can be manufactured inexpensively and which avoids the use of trouble-prone media supplies to the positioning drives.

SUMMARY OF THE INVENTION

In accordance with the present invention, the plungers of the reel shafts maintain the segments of the drums in the spread-apart position by means of compression springs. At least one stationary positioning drive is provided which includes a positioning member which is capable of pressing on the plunger against the force of the compression spring in order to carry out the movement of the segments of the reel from the spread-apart position. The positioning drive further includes a coupling jaw which can be moved with play into corresponding coupling elements of the reel shafts by rotating the head plate, so that a locking connection of the positioning drive is effected with the reel which has been moved into the position in which the positioning drive moves the segments from the spread-apart position.

The use of reels whose drums are maintained in the spread-apart position by means of the force of a spring makes it unnecessary to rotate the positioning drives together with the reel and the head plate. A stationary positioning drive is only required wherein the strip coil is removed from or placed on the reel, wherein the positioning drive is always connected to the feed line through fixed media supplies. In order to ensure that during the movement of the segments of the reel drum from the spread-apart position no forces will act on the bearings of the reel shaft in axial direction and that no forces act on the bearings of the head plate, the reel shaft as well as the positioning drives have coupling elements which are brought into locking engagement prior to every spreading movement of the positioning drive, so that any axial forces which may occur are absorbed by this connection.

It has been found advantageous to provide the stationary positioning drive in the strip coil transfer position.

In the case of winding reels it is useful to provide a second stationary positioning drive within the range of the initial position where the beginning of the strip is grasped. In that case, the positioning drive in the strip coil transfer position may carry out a full stroke for moving the segments from the spread-apart position, while the positioning drive in the initial position does only have to effect a stroke which slightly moves the segments from the spread-apart position.

The full movement of the segments of the reel drum from the spread-apart position in the strip coil transfer position permits the removal of the wound strip coils. The partial movement of the segments in the initial position facilitates the winding of the beginning of the strip. The first two to three windings are wound with the segments of the reel drum being partially moved from the spread-apart position. Subsequently, the spread-apart position is assumed, so that the initial windings will be securely placed on the reel drum. During winding in the position of the reel with the segments being partially moved from the spread-apart position, the rotation of the reel is absorbed by appropriate bearings at the coupling jaw of the stationary positioning drive.

The positioning drives advantageously are composed of two drive units, namely, a spreading drive movable on guide members and a displacement drive which moves the spreading drive.

It is significant that the displacement drive can be moved in such a way that the play provided between the coupling jaw and the coupling element of the reel shaft is eliminated and then again created after the segments of the drawings have been moved from the spread-apart position. This play is absolutely necessary, so that damage is avoided during the movement of the reel into the position of the positioning drive for effecting the movement of the segments from the spread-apart position. On the other hand, during the movement of the segments such a play would be disadvantageous because undesirable forces would be transmitted to the reel shaft and head plate.

An even simpler and more inexpensive positioning drive is obtained when a spreading and displacement drive placed on a guide is used. This has the advantage that the spreading and displacement drive can be moved in order to eliminate the play provided between the coupling jaw and the coupling element of the reel shaft and, together with a stop member, to again restore the play after the segments have been moved from the spread-apart position.

Another advantageous embodiment of the reversible reel assembly according to the invention is obtained by providing at least one reel with a stop member for effecting a properly centered positioning of a rolled strip sleeve on the reel drum.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
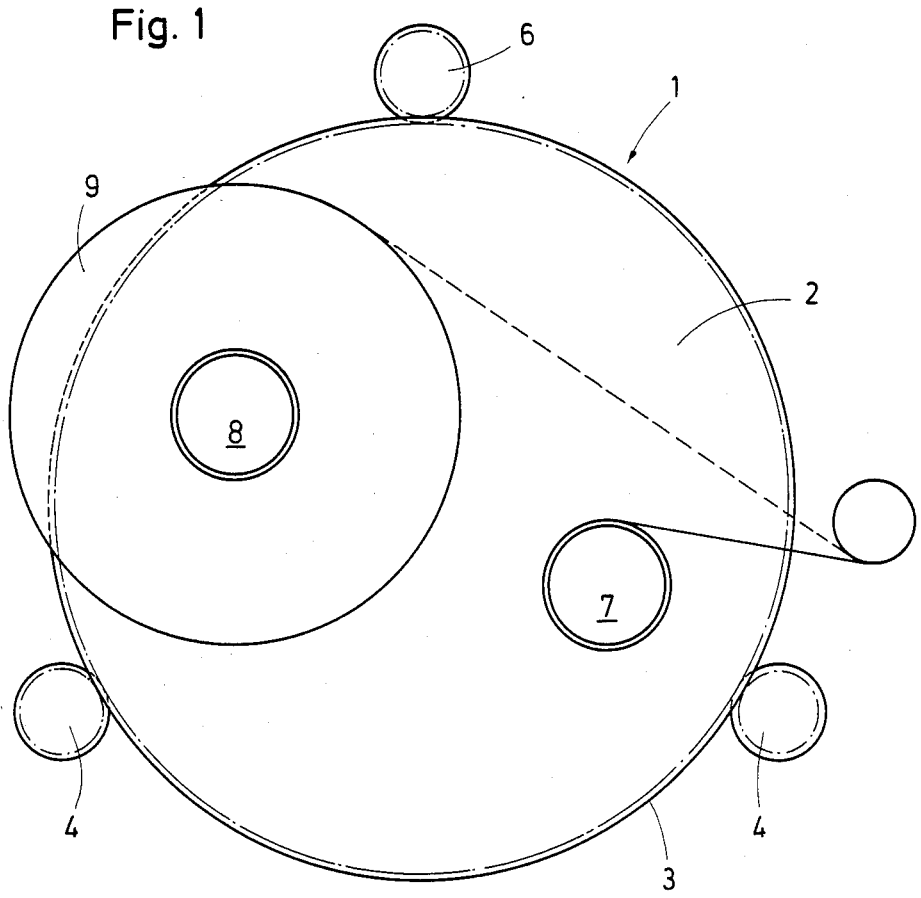
FIG. 1 is a schematic front elevational view of a reversible reel assembly according to the invention.

A reel assembly in accordance with the present invention is illustrated in FIG. 1 in a front elevational view. The reel assembly 1 has a head plate 2 with a spur wheel-type toothing 3 which is engaged by drive gears 4 of motors 5, as particularly illustrated in FIG. 2, and by a guide wheel 6. Head plate 2 can be rotated clockwise or counterclockwise by means of drive gears 4 in accordance with the desired mode of operation, i.e., winding off or winding up. The motors 5 can be controlled in such a manner that suddenly occurring changes in the tooth engagement between the drive gears 4 and the toothing 3 of the head plate 2 which are due to uneven weight distributions at the head plate 2 are eliminated.

Reels 7 and 8 are rotatedly mounted on an extend through head plate 2. Reels 7 and 8 are of equal construction, however, as illustrated in the drawing, reel 7 is in the initial position in which the beginning of the strip is grasped by loops which are not shown and in which some windings are wound. Reel 8, on the other hand, is illustrated in the strip coil transfer position in which a completely wound coil strip has been wound onto reel 8.

Figure 2:
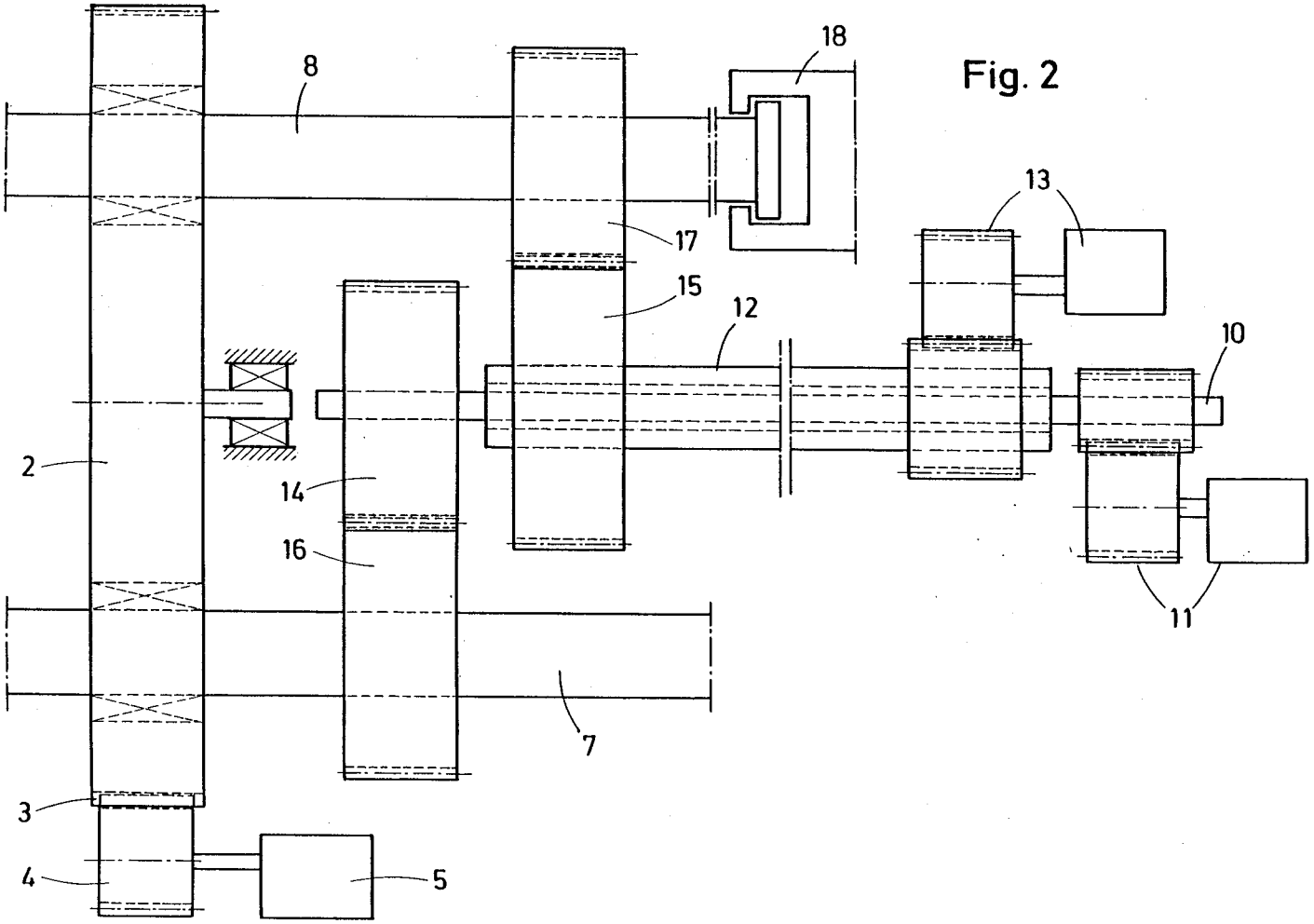
FIG. 2 is a schematic illustration of the drive arrangement of the reversible reel assembly illustrated in FIG. 1.

The rotary drives 4 and the reels 7 and 8 are located on the rear side of head plate 2, as can be seen in FIG. 2. It is significant that reel 7 is in drive connection through a central shaft 10 with stationary drive 11 and that reel 8 is in drive connection with drive 13 which is also stationary through a tubular shaft 12 which is mounted coaxially with central shaft 10. Gears 14 and 15 are mounted on the ends of central shaft 10 and hollow shaft 12, respectively. Gears 14 and 15 are in meshed engagement with gears 16 and 17 mounted on reels 7 and 8 so as to rotate therewith. A positioning drive 18 is engaged with reel 8.

The type of drive used for reels 7 and 8 makes it unnecessary to provide rotary drives which are fixedly mounted on the reels and which would have to be supplied with energy through complicated and trouble-prone rotary supply units. In addition, this type of drive ensures that the weights to be driven are very small.

Figure 3:
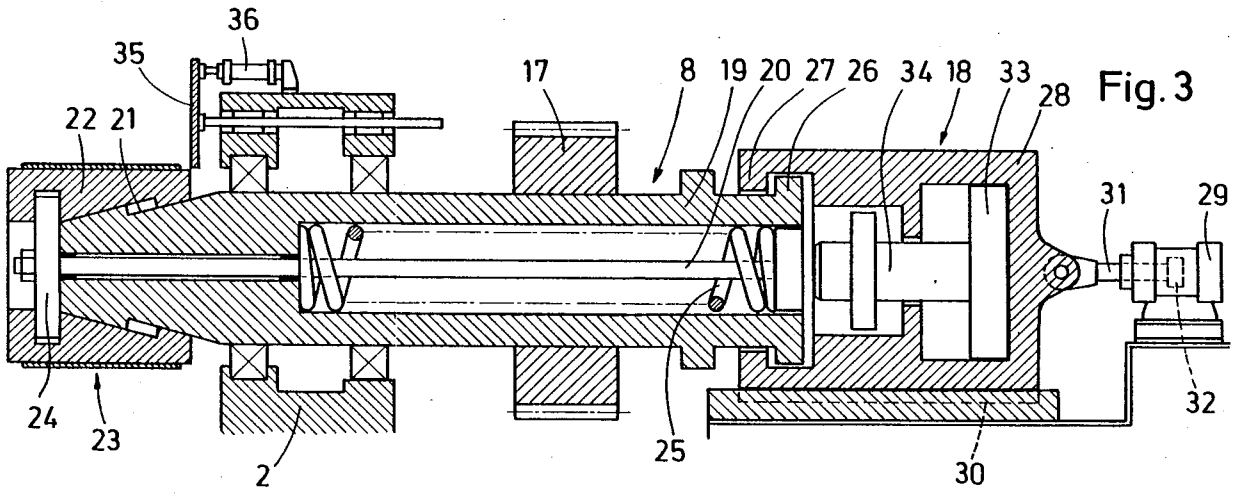
FIG. 3 is a sectional view of a reel moved into the positioning drive of the strip coil transfer position.

In FIG. 3, reel 8 is shown in the strip coil transfer position. Reel 8 is moved into the positioning drive 18.

Reel 8 is composed of a reel shaft 19 in which a plunger 20 is axially movably supported. Reel shaft 19 has conically-shaped sliding surfaces 21 on which segments 22 are axially movably supported. An axial movement of segments 22 on the conically formed sliding surfaces 21 causes spreading of the segments 22 forming reel drum 23. Segments 22 are connected to plunger 20 through a connecting flange 24. The reel drum 23 is maintained in the spread-apart position by means of a compression spring 25 provided between reel shaft 19 and plunger 20. The reel drum 23 can be moved from the spread-apart position by moving plunger 20 against the force of compression spring 25.

A coupling element 26 is provided at the free end of the reel shaft 19. Coupling element 26 is moved with play into the coupling jaw 27 of positioning drive 18.

Positioning drive 18 has a spreading drive 28 and a displacement drive 29. Spreading drive 28 can be moved back and forth in the direction of reel 8 on guides 30. The movement is effected by means of a piston 31 of displacement drive 29 which is connected to the spreading drive 28 through piston rod 31.

Figure 4:
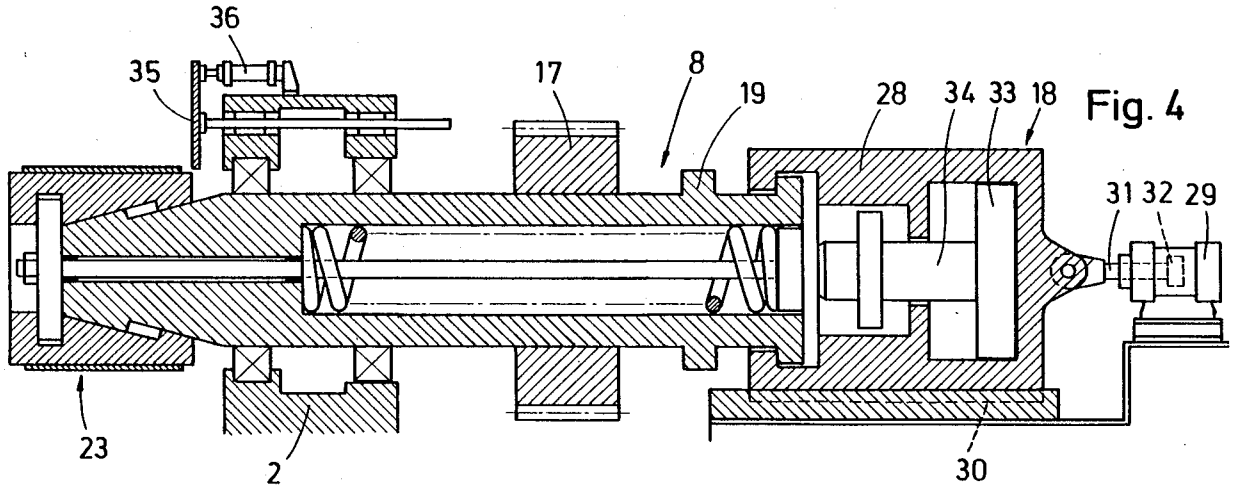
FIG. 4 is a sectional view of the reel illustrated in FIG. 3, with the play between the coupling element and the coupling jaw being eliminated.

As illustrated in FIG. 4, the play existing between the coupling jaw 27 at the spreading drive 28 and the coupling element 26 at the reel shaft 19 has been eliminated. To this end, piston 31 has been moved in such a way that spreading drive 28 has been displaced on guides 30 by the reel shaft 19. As a result, a locked engagement was obtained between positioning drive 18 and reel 8, without creating axial forces which would act on reel shaft 19.

Figure 5:
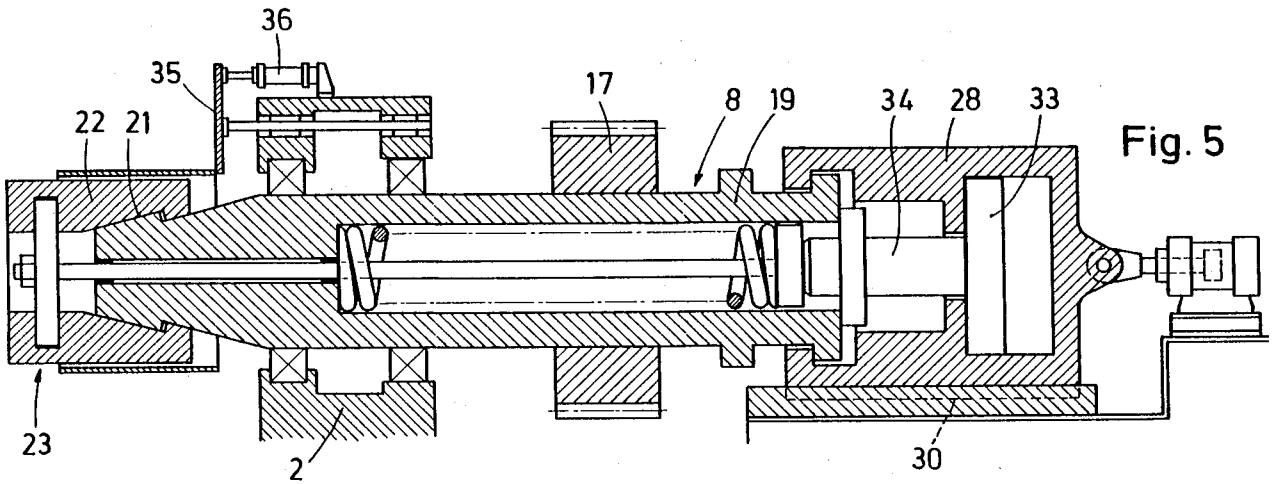
FIG. 5 is a sectional view of the reel illustrated in FIG. 3, with the segments moved from the spread-apart position.

FIG. 5 shows reel 8 with the reel drum 23 moved from the spread-apart position. Piston 33 of spreading drive 28 has been moved in the direction toward reel shaft 19. Piston rod 34 has moved plunger 20 against the force of compression spring 25 in axial direction and segments 22 have been moved on the conically formed sliding surfaces 21 into the position in which the segments are moved from the spread-apart position.

After the strip coil 9 has been transferred, reel drum 23 is again spread apart by pulling back to the piston rod 34 and by plunger 20 which is moved back by the force of compression spring 25. Subsequently, by actuating the displacement drive 29, the play between coupling element 26 and coupling jaw 27 is again restored, so that reel 8 can be moved out of the strip coil transfer position.

In conventional reversible reel assemblies of the type involved, the positioning drives rigidly mounted on the reels must be separated in such a way that the pistons of the positioning drives perform a large stroke in the strip coil transfer position and a small stroke in the initial position. The large stroke is used in order to completely move the segments of the reel drum from the spread-apart position, so that the strip coils can be removed. The small stroke merely has the purpose to facilitate the winding and securing of the first windings of the rolled strip on the reel drum.

In the reversible reel assembly in accordance with the invention, the positioning drive in the initial position only carries out a small stroke, while the positioning drive carries out a great stroke in the strip coil transfer position. It is not necessary to provide means for operating a positioning drive both to effect a large stroke and a small stroke.

FIGS. 3–5 illustrate a stop member 35 which is assigned to reel 8. The stop member 35 is controlled by a piston-cylinder unit 36 and serves for properly centering a rolled strip sleeve on reel drum 23.

Figure 6:
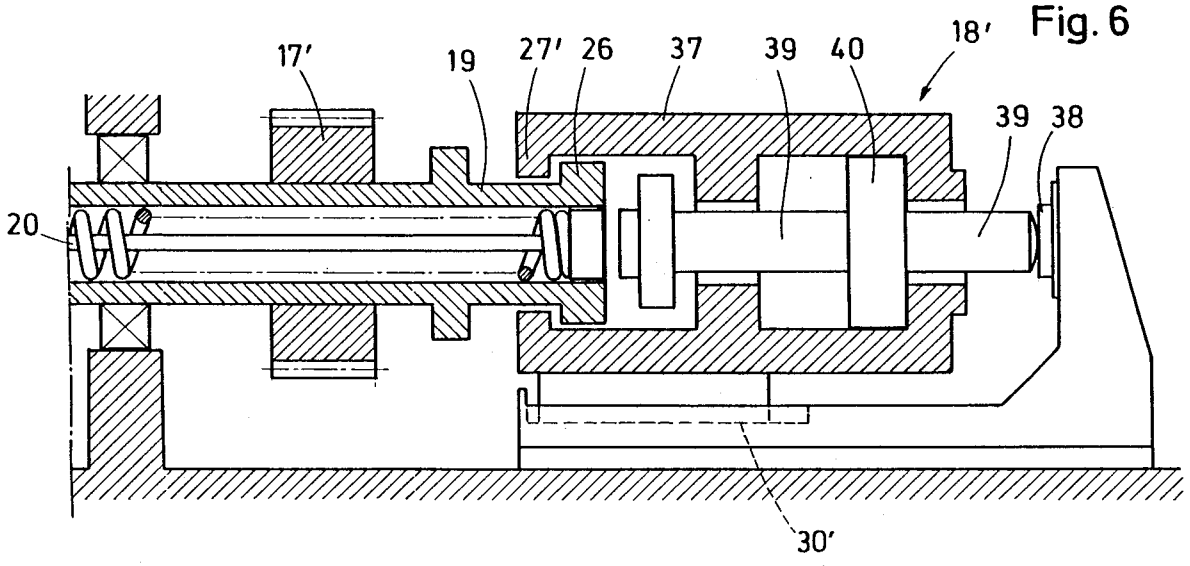
FIG. 6 is a sectional view of a reel with a positioning drive formed by a spreading and displacement drive.

FIG. 6 illustrates a positioning drive 18′ which, compared to positioning drive 18 illustrated in FIGS. 3–5, is of simple construction and less expensive to manufacture.

Positioning drive 18′ includes a spreading and displacement drive 37 which is capable of effecting the movements of the spreading and displacement drive 37 which eliminate and again restore the play between the coupling element 26 and the coupling jaw 27′. Drive 37 is also capable of effecting the movement of plunger 20 for moving the segments from the spread-apart position.

The play existing between the coupling element 26 and the coupling jaw 27′ is eliminated by moving piston rod 39 against plunger 20. When the piston 40 is moved further, the entire spreading and displacement drive 37 is moved on guide 30′ away from plunger 20. Once the play between coupling element 26 and coupling jaw 27′ is eliminated, a further movement of piston 40 causes plunger 20 to move relative to reel shaft 19 so as to effect a movement of the segments away from the spread-apart position.

If the play between coupling element 26 and coupling jaw 27′ is to be restored so that the reel can be moved from the coil-forming position or coil transfer position, the piston 40 is moved in such a way that piston rod 39 is moved against a stop member 38. A further movement of piston 40 causes the spreading and displacement drive 37 to be moved on guide 30′ toward plunger 20. Thus, the play between coupling element 26 and coupling jaw 27′ is again restored.

While specific embodiments of the invention have been shown and described in detail to illustrate the application of the inventive principles, it will be understood that the invention may be embodied otherwise without departing from such principles.

We claim:

1. A reversible reel assembly comprising a rotatable head plate, two rotatable reels for successive, continuously winding rolled strip, the two reels mounted on the rotatable head plate and rotatably driven independently from each other, wherein each reel is movable by a rotation of the head plate between an initial position and a strip coil transfer position, each reel comprising a drum including a plurality of segments movable between a first position of rest and a second spread-apart position, the segments defining conically-shaped sliding surfaces, a tubular reel shaft mounted on the head plate for each reel, each shaft having an axis and an end facing the reel drum, the sliding surfaces axially slidably contacting the end of the shaft, a plunger extending axially through each reel shaft, a flange attached to an end of the plunger for connecting the plunger to the segments, so that an axial movement of the plunger moves the segments between the first and second positions thereof, a compression spring mounted in each tubular shaft, the spring acting on the plunger so as to bias the segments into the spread-apart position, at least one stationary positioning drive including a positioning member, the positioning member capable of acting on the plunger for moving the plunger in axial direction against the force of the compression spring so as to move the segments into the first position of rest, the positioning drive further including a coupling jaw, the reel shaft defining coupling elements, wherein the coupling elements is movable with play into the coupling jaw when the head plate is rotated, so that a locking engagement is effected between the positioning drive and the reel which is in the position for moving the segments into the first position.

2. Reversible reel assembly according to claim 1, wherein the at least one stationary positioning drive is arranged in the strip coil transfer position.

3. Reversible reel assembly according to claims 1 or 2, wherein a second stationary positioning drive is provided in the initial position in which the beginning of the strip is grasped.

4. Reversible reel assembly according to claim 3, wherein the positioning drive in the strip coil transfer position is capable of performing a full spreading stroke, and the positioning drive in the initial position is capable of effecting only a small stroke, so that the segments of the drum are only slightly moved from the spread-apart position.

5. Reversible reel assembly according to claim 3, wherein the positioning drives are formed by two drive units.

6. Reversible reel assembly according to claim 5, wherein the drive units are piston-cylinder units.

7. Reversible reel assembly according to claim 5, wherein each positioning drive includes a spreading drive movable on guides and a displacement drive which moves the spreading drive.

8. Reversible reel assembly according to claim 5, wherein the displacement drive is movable so as to eliminate and restore the play existing between the coupling jaw and the coupling elements of the reel shafts.

9. Reversible reel assembly according to claim 1, wherein a stop member is provided for at least the reel in the strip coil transfer position for effecting a centered positioning of a rolled strip sleeve on the reel drum.

10. Reversible reel assembly according to claim 1, wherein the positioning drive includes a spreading and displacement drive which is movable on guides.

11. Reversible reel assembly according to claim 10, wherein the spreading and displacement drive is movable together with a stop member for eliminating and restoring the play existing between the coupling jaw and the coupling elements of the reel shaft.

* * * * *